US010359231B2

(12) United States Patent
Degenstein

(10) Patent No.: US 10,359,231 B2
(45) Date of Patent: Jul. 23, 2019

(54) METHOD FOR CONTROLLING PRODUCTION OF HIGH PRESSURE GASEOUS OXYGEN IN AN AIR SEPARATION UNIT

(71) Applicant: Nick J. Degenstein, East Amherst, NY (US)

(72) Inventor: Nick J. Degenstein, East Amherst, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 296 days.

(21) Appl. No.: 15/485,635

(22) Filed: Apr. 12, 2017

(65) Prior Publication Data

US 2018/0299195 A1 Oct. 18, 2018

(51) Int. Cl.
*F25J 3/04* (2006.01)

(52) U.S. Cl.
CPC ..... *F25J 3/04412* (2013.01); *F25J 3/0409* (2013.01); *F25J 3/04175* (2013.01); *F25J 3/04296* (2013.01); *F25J 3/04303* (2013.01); *F25J 3/04678* (2013.01); *F25J 3/04812* (2013.01); *F25J 3/04836* (2013.01); *F25J 3/04884* (2013.01); *F25J 2200/54* (2013.01); *F25J 2215/54* (2013.01); *F25J 2245/40* (2013.01); *F25J 2250/02* (2013.01)

(58) Field of Classification Search
CPC .... F25J 3/04412; F25J 3/0409; F25J 3/04175; F25J 3/04296; F25J 3/04303; F25J 3/04678; F25J 3/04812; F25J 3/04836; F25J 3/04884; F25J 2200/54; F25J 2245/40; F25J 2250/02; F25J 3/04024; F25J 2200/06; F25J 3/0483; F25J 2210/16; F25J 2230/00; F25J 2240/00
See application file for complete search history.

(56) References Cited

U.S. PATENT DOCUMENTS 2,520,862 A * 8/1950 Swearingen ..... F25J 3/04018 62/646
2,708,831 A * 5/1955 Wilkinson ..... F25J 3/0409 62/643
3,273,349 A * 9/1966 Litvin ..... F25J 3/04224 62/50.2
5,265,429 A * 11/1993 Dray ..... F25J 3/0409 62/646
5,379,598 A * 1/1995 Mostello ..... F25J 3/04054 62/646
5,421,166 A * 6/1995 Allam ..... F01K 23/068 60/39.12

(Continued)

FOREIGN PATENT DOCUMENTS

EP 2 963 367 A1 1/2016
GB 1 216 192 12/1970
WO 2015/082860 A2 6/2015

*Primary Examiner* — Melvin Jones
(74) *Attorney, Agent, or Firm* — Robert J. Hampsch

(57) ABSTRACT

A method for controlling production of high pressure gaseous oxygen in a cryogenic air separation unit that uses a high pressure gaseous oxygen bypass together with adjustments to the split of the incoming compressed and purified air between the boiler air circuit and the turbine air circuit such that the volumetric ratio of the boiler air stream to the turbine air stream is reduced to between about 0.15:1 and 0.35:1.

17 Claims, 3 Drawing Sheets

(56) References Cited

U.S. PATENT DOCUMENTS

| | | | | |
|---|---|---|---|---|
| 5,590,543 | A | 1/1997 | Agrawal et al. | |
| 5,928,408 | A | 7/1999 | Higginbotham | |
| 6,062,044 | A * | 5/2000 | Bernard | F25J 3/0409 62/647 |
| 6,345,493 | B1 * | 2/2002 | Smith | F02C 6/02 60/772 |
| 7,228,715 | B2 * | 6/2007 | Brugerolle | F25J 1/0012 62/643 |
| 8,726,691 | B2 * | 5/2014 | Jibb | F25J 3/0409 62/644 |
| 9,534,836 | B2 * | 1/2017 | Dubettier-Grenier | F25J 3/04018 |
| 2009/0120129 | A1 | 5/2009 | Howard | |
| 2011/0011130 | A1 | 1/2011 | Guillard et al. | |
| 2015/0345857 | A1 | 12/2015 | Rauch et al. | |

* cited by examiner

METHOD FOR CONTROLLING PRODUCTION OF HIGH PRESSURE GASEOUS OXYGEN IN AN AIR SEPARATION UNIT

TECHNICAL FIELD

The present invention relates to a method and system for cryogenic air separation, and more particularly, to a method for varying the production of a high pressure gaseous oxygen product in an air separation unit. Still more particularly, the present method involves extracting and venting a high oxygen content gaseous stream from the lower pressure column of a cryogenic air separation unit so as to reduce the production of gaseous oxygen product when the demand for high pressure gaseous oxygen product is low while concurrently reducing the volumetric flow rate of the incoming boiler air stream and increasing the volumetric flow rate of the incoming turbine air stream.

BACKGROUND

Cryogenic air separation plants are typically designed, constructed and operated to meet the baseload product slate demands/requirements for one or more end-user customers and optionally the local or merchant liquid product market demand. Product slate requirements typically include a target volume of high pressure gaseous oxygen, as well as various co-products such as gaseous nitrogen, liquid oxygen, liquid nitrogen, and/or liquid argon. The air separation plant is designed and operated based, in part, on the selected design conditions, including the typical day ambient conditions as well as the available utility/power supply costs and conditions Changes in customer demand for high pressure gaseous oxygen product from an air separation unit (ASU) plant are common, particularly for certain customers connected via a pipeline to a dedicated ASU plant. For example, steel making customers operating electric arc furnaces typically require a continuously varying high pressure gaseous oxygen demand that can range from basically no flow of high pressure gaseous oxygen to a peak flow greater than the gaseous oxygen capacity of the ASU in a matter of just a few minutes.

To meet these rapidly varying high pressure gaseous oxygen demands, it is desirable to change the ASU plant operating characteristics in order to adjust product flow variations. However, most ASU plants cannot rapidly adjust to the dramatic or extreme fluctuations in gaseous oxygen demand by varying the incoming feed air flow rate as the ASU plant dynamics are typically not fast enough to change operating points or to maintain product purities in these short timeframes. In addition, such extreme fluctuations in high pressure gaseous oxygen demand often lead to extreme operational swings which can adversely impact the reliability and maintainability of the ASU plant equipment, particularly, the compressors and turbo-expanders. Further problems associated with changing high pressure gaseous oxygen demands, rapidly or otherwise, is the impact to the production rate of any ASU plant co-products, such as gaseous nitrogen, liquid nitrogen, liquid oxygen, and argon.

As a result, the most common prior art solution to address the rapid decrease in high pressure gaseous oxygen demands is to have the ASU plant produce the high pressure gaseous oxygen at full capacity and vent any unwanted or unneeded high pressure gaseous oxygen to the atmosphere, while the ASU plant is slowly turned down. In situations, where a rapid increase in gaseous oxygen demand are expected, the ASU plant often continues to produce high-pressure gaseous oxygen at full capacity and without turn-down while continuously venting any excess high pressure gaseous oxygen product. Also, in situations when customer demand for high pressure gaseous oxygen is reduced but there remains a need to maintain production of various co-products, the high pressure gaseous oxygen is often vented incurring the operating cost penalty of venting the high pressure gaseous oxygen without any mitigating benefit.

Examples of the prior art venting of high pressure gaseous oxygen can be found in United States Patent Application publications Nos. 2009/0120129; and US2011/0011130 as well as U.S. Pat. Nos. 5,590,543; and 5,928,408.

Accordingly, there is a need to more quickly respond to rapid changes in high pressure gaseous oxygen demand from an ASU plant while avoiding the operating cost penalty associated with venting of high pressure gaseous oxygen. Ideally, such rapid response would also achieve or facilitate advantages and benefits such as concurrently increasing the argon or liquid nitrogen production from the ASU.

SUMMARY OF THE INVENTION

The present invention may be characterized as a method for producing a high pressure gaseous oxygen product in an air separation unit comprising a primary heat exchanger and a distillation column system with a higher pressure column, a lower pressure column, and a main condenser-reboiler disposed in the lower pressure column and in a heat exchange relationship with the lower pressure column and higher pressure column, the air separation unit is configured to be operated in a high pressure gaseous oxygen full product mode and a high pressure gaseous oxygen bypass mode, the method comprising the steps of: (a) compressing and purifying a stream of feed air, the stream of feed air having a first volumetric flow rate; (b) splitting the stream of compressed and purified feed air into two or more streams including a boiler air stream and a turbine air stream, wherein the volumetric flow ratio of the boiler air stream to the turbine air stream is between about 0.40:1 and 0.70:1; (c) directing the boiler air stream to a boiler air circuit configured to further compress the boiler air stream in a boiler air compressor and directing the turbine air stream to a turbine air circuit configured to partially cool the turbine air stream in the primary heat exchanger and expand the turbine air stream and produce refrigeration for the distillation column system; (d) cooling the further compressed boiler air stream in the primary heat exchanger via indirect heat exchange with a stream of liquid oxygen taken from the lower pressure column to produce a cooled, compressed feed air stream and a gaseous oxygen product; (e) directing the first cooled, compressed feed air stream to the higher pressure column, the lower pressure column or both columns and directing the expanded turbine air stream to the higher pressure column or the lower pressure column; (f) rectifying the cooled, compressed feed air stream and the expanded turbine air stream in the distillation column system to produce a stream of gaseous nitrogen product, a stream on liquid nitrogen, a stream of waste nitrogen, the stream of liquid oxygen; and optionally one or more argon products; and (g) warming all or a portion of the liquid oxygen stream in the primary heat exchanger to produce the high pressure gaseous oxygen product. However, when in the air separation plant operates in a high pressure gaseous oxygen bypass mode, the method further comprises the steps of: (h) extracting a stream of gaseous oxygen from the lower pressure column at a location above the main condenser-reboiler; (i) recovering part or all of the refrigeration from the extracted gaseous oxygen stream in the primary heat exchanger or other heat exchanger; and (j) reducing the volumetric ratio of the further compressed boiler air stream directed to the primary heat exchanger to the turbine air stream directed to the primary heat exchanger to between about 0.15:1 and 0.35:1.

In lieu of or in addition to the step of reducing the volumetric ratio of the further compressed boiler air stream directed to the primary heat exchanger to the turbine air stream directed to the primary heat exchanger to between about 0.15:1 and 0.35:1, one can direct all or a portion of the boiler air stream in the boiler air circuit to the primary heat exchanger while bypassing boiler air compressor so as to avoid further compression of the boiler air stream.

Several advantages and/or benefits associated with operating the air separation unit in the high pressure gaseous oxygen bypass mode may include a reduction in power consumption required to make same volume of liquid products when operating in the high pressure gaseous oxygen bypass mode compared to operating in the high pressure gaseous oxygen full product mode, preferably between about 10% less power and 20% less power. Alternatively, an increase in liquid product make for the same power consumption may be realized. Specifically, between about 5% and 10% additional liquid products can be produced when operating the air separation unit in the high pressure gaseous oxygen bypass mode compared to operating in the high pressure gaseous oxygen full product mode.

The above-identified advantages and/or benefits associated with operating the air separation unit in the high pressure gaseous oxygen bypass mode may be realized when the air separation unit is in full-flow mode as well as in turndown mode where the volumetric flow rate of the incoming feed air stream is less than 85% of the designed volumetric flow rate of the air separation plant.

In some embodiments of the present method, the step of reducing the volumetric ratio of the boiler air stream directed to the primary heat exchanger to the turbine air stream directed to the primary heat exchanger to between about 0.15:1 and 0.35:1 may be achieved by diverting a portion of the further compressed boiler air stream from a location upstream of the primary heat exchanger to the turbine air circuit. Alternatively, a portion of the further compressed boiler air stream might be recirculated from a location in the boiler air circuit downstream of upstream of the primary heat exchanger to a location in the boiler air circuit upstream of the boiler air compressor. Still further, a portion of the boiler air stream may simply bypass the boiler air compressor by diverting some or all of the boiler air stream from a location in the boiler air circuit upstream of the boiler air compressor to a location in the boiler air circuit downstream of the boiler air compressor so as to avoid further compression of said portion of the boiler air stream. When operating the air separation unit in the high pressure gaseous oxygen bypass mode, the steps of: (i) diverting the further compressed boiler air stream to the turbine air stream (i.e. cross-tie arrangement); (ii) recirculation of the further compressed boiler air stream back to the boiler air stream; and (iii) bypassing the boiler air compressor may be performed individually or in combination. In addition, the disclosed methods may be implemented in systems where the boiler air compressor is a stand-alone compressor unit or a multi-stage boiler air compressor arrangement.

BRIEF DESCRIPTION OF THE DRAWINGS

While the present invention concludes with claims distinctly pointing out the subject matter that Applicants regard as their invention, it is believed that the invention will be better understood when taken in connection with the accompanying drawings in which:

DETAILED DESCRIPTION

Figure 1:
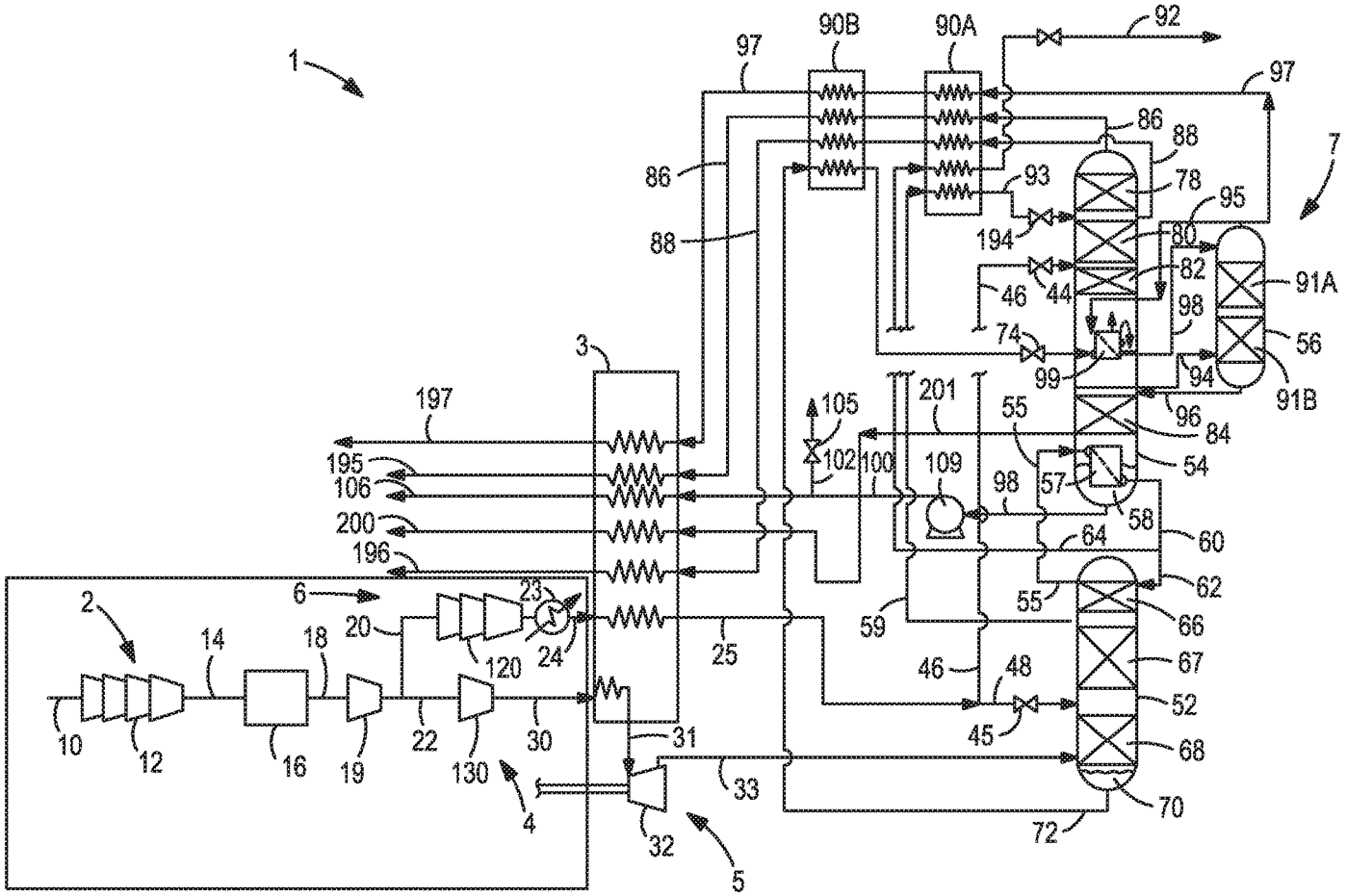
FIG. 1 is a schematic representation of a cryogenic air separation unit configured to produce a high pressure gaseous oxygen product in accordance with the present methods.

Turning now to FIG. 1, there is shown a simplified illustration of a cryogenic air separation plant 1 also commonly referred to as an air separation unit (ASU). In a broad sense, the cryogenic air separation plant or ASU includes a main feed air compression train 2, a turbine air compression circuit 4, a booster air compression circuit 6, a main or primary heat exchanger 3, a turbine based refrigeration circuit 5 and a distillation column system 7. As used herein, the main feed air compression train 2, the optional turbine air compression circuit 4, and the booster air compression circuit 6, collectively comprise the 'warm-end' air compression circuit. Similarly, the main or primary heat exchanger 3, portions of the turbine based refrigeration circuit 5 and portions of the distillation column system 7 are referred to as the 'cold-end' equipment that are typically housed in one or more insulated cold boxes.

Warm End Air Compression Circuit

In the main feed compression train 2 shown in FIG. 1, the incoming feed air 10 is drawn through an air suction filter house (ASFH) and is compressed in a multi-stage, intercooled main air compressor arrangement 12 to a pressure that can be between about 5 bar(a) and about 15 bar(a). This main air compressor arrangement 12 may include integrally geared compressor stages or a direct drive compressor stages, arranged in series or in parallel as shown. The air exiting the main air compressor arrangement is fed to an aftercooler with integral demister to remove the free moisture in the incoming feed air stream. The heat of compression from the final stages of compression for the main air compressor arrangement 12 is removed in aftercooler(s) by cooling the compressed feed air with cooling tower water. The condensate from this aftercooler as well as some of the intercoolers in the main air compression arrangement is preferably piped to a condensate tank and used to supply water to other portions of the air separation plant.

The cool, dry compressed air feed 14 is then purified in a pre-purification unit 16 to remove high boiling contaminants from the cool, dry compressed air feed 14. A pre-purification unit 16, as is well known in the art, typically contains two beds of alumina and/or molecular sieve operating in accordance with a temperature and/or pressure swing adsorption cycle in which moisture and other impurities, such as carbon dioxide, water vapor and hydrocarbons, are adsorbed. While one of the beds is used for pre-purification of the cool, dry compressed air feed 14 while the other bed is regenerated, preferably with a portion of the waste nitrogen from the air separation unit. The two beds switch service periodically. Particulates are removed from the compressed, pre-purified feed air in a dust filter disposed downstream of the pre-purification unit 16 to produce the compressed, purified feed air stream 18.

As described in more detail below, the compressed, purified feed air stream 18 is separated into oxygen-rich, nitrogen-rich, and argon-rich fractions in a plurality of distillation columns including a higher pressure column 52, a lower pressure column 54, and optionally, argon columns 56. Prior to such distillation however, the compressed, pre-purified feed air stream 18 is split into a plurality of feed air streams, including a boiler air stream 20 and a turbine air stream 22 described in more detail below. The boiler air stream 20 and turbine air stream 22 are cooled to temperatures required for rectification. Cooling the boiler air stream 20 is preferably accomplished by way of indirect heat exchange in main or primary heat exchanger 3 with the warming streams which include the oxygen, nitrogen and/or argon streams from the distillation column system 7. Refrigeration is also typically generated by the turbine air stream 22 and associated cold and/or warm turbine arrangements disposed within the turbine based refrigeration circuits 5 and/or any optional closed loop warm refrigeration circuits.

In the illustrated embodiment, the compressed and purified feed air stream 18 is further compressed in first booster compressor and then divided into a boiler air stream 20, and a turbine air stream 22. Boiler air stream 20 is generally about 25% to 40% of the compressed and purified feed air stream 18 and is yet further compressed within a booster compressor arrangement 120, which preferably comprises yet another single or multi-stage intercooled booster compressor and aftercooler 23. As with the main air compressor arrangement 12, this booster compressor arrangement 120 may include an integrally geared compressor or a direct drive compressor. This booster compressor arrangement 120 further compresses the boiler air stream 20 to a targeted pressure between about 25 bar(a) and about 70 bar(a) to produce a further compressed boiler air stream 24. The further compressed boiler air stream 24 is directed or introduced into main or primary heat exchanger 3 where it is used to boil a liquid oxygen stream 86 via indirect heat exchange to produce a high pressure gaseous oxygen product stream 88. The cooled boiler air stream becomes liquid air stream 25. The liquid air stream 25 is subsequently divided into liquid air streams 46 and 48 which are then partially expanded in expansion valve(s) 44, 45 and for introduction into the lower pressure column 54 and higher pressure column 52 respectively. The target pressure of the further compressed boiler air stream 24 is generally dictated by the product requirements for the high pressure gaseous oxygen product stream.

As illustrated, second stream, often referred to as the turbine air stream 22, is generally about 60% to 75% of the compressed and purified feed air stream 18 and is optionally further compressed in a turbine air compressor 130, prior to being directed to a turbine based refrigeration circuit 5, as described below.

As described in more detail below with references to FIGS. 2-6, when operating the air separation unit 1 with gaseous oxygen bypass in full flow mode, the boiler air stream 20 flow is reduced to less than or equal to 25% and more preferably between about 15% to 25% of the full-flow compressed and purified feed air stream 18. The boiler air stream 20 is then further compressed within a booster compressor arrangement 23 to a targeted pressure to produce the further compressed boiler air stream 24. Concurrently, turbine air stream 20 flow is increased to greater than or equal to about 75% and more preferably to between about 75% to 85% of the full-flow compressed and purified feed air stream 18. The turbine air stream 22 is then further optionally compressed to produce the further compressed turbine air stream.

Alternatively, when operating the air separation unit with gaseous oxygen bypass in turndown mode, the boiler air stream 20 flow may also be reduced to less than 30% and more preferably between about 15% to 30% of the reduced-flow compressed and purified feed air stream 18 while the turbine air stream 20 flow is increased to greater than or equal to about 70% and more preferably to between about 70% to 85% of the reduced-flow compressed and purified feed air stream 18. The boiler air stream 20 is then further compressed to a targeted pressure while the turbine air stream 22 is optionally further compressed.

Cold End Systems and Equipment

The main or primary heat exchanger 3 is preferably a brazed aluminum plate-fin type heat exchanger. Such heat exchangers are advantageous due to their compact design, high heat transfer rates and their ability to process multiple streams. They are manufactured as fully brazed and welded pressure vessels. For small ASU plants, a heat exchanger comprising a single core may be sufficient. For larger ASU plants handling higher flows, the heat exchanger may be constructed from several cores which must be connected in parallel or series.

Turbine based refrigeration circuits are often referred to as either a lower column turbine (LCT) arrangement or an upper column turbine (UCT) arrangement which are used to provide refrigeration to a two-column or three column cryogenic air distillation column system. In the LCT arrangement shown in FIG. 1, the compressed turbine air stream 30 is preferably at a pressure in the range from between about 20 bar(a) to about 60 bar(a). The compressed turbine air stream 30 is directed or introduced into main or primary heat exchanger 3 in which it is partially cooled to a temperature in a range of between about 160 and about 220 Kelvin to form a partially cooled, compressed turbine air stream 31 that is subsequently introduced into a turbo-expander 32 to produce an exhaust stream 34 that is introduced into the higher pressure column 52 of distillation column system 7. In some embodiments, turbo-expander 32 may be coupled with booster compressor 130 used to further compress the turbine air stream 22, either directly or by appropriate gearing.

While the turbine based refrigeration circuit 5 illustrated in FIG. 1 is shown as a lower column turbine (LCT) circuit where the expanded exhaust stream is fed to the higher pressure column of the distillation column system 7, it is contemplated that the turbine based refrigeration circuit alternatively may be an upper column turbine (UCT) circuit where the turbine exhaust stream is directed to the lower pressure column. Still further, the turbine based refrigeration circuit may be a combination of an LCT circuit and UCT circuit and/or even other variations such as a partial lower column turbine (PLCT).

All or a portion of this further compressed, partially cooled stream is diverted to a turbo-expander 32, which may be operatively coupled to and drive a compressor. The expanded gas stream or exhaust stream 33 is then directed to higher pressure column 52 of a two column or three column cryogenic air distillation column system. The supplemental refrigeration created by the expansion of the partially cooled stream 31 is thus imparted directly to the higher pressure column 52 thereby alleviating some of the cooling duty of the primary heat exchanger 3.

Similarly, in an alternate embodiment that employs a UCT arrangement (not shown), a portion of the purified and compressed feed air may be partially cooled in the primary heat exchanger, and then all or a portion of this partially cooled stream is diverted to a warm turbo-expander. The expanded gas stream or exhaust stream from the warm turbo-expander is then directed to the lower pressure column in the two-column or three column cryogenic air distillation column system. The cooling or supplemental refrigeration created by the expansion of the exhaust stream is thus imparted directly to the lower pressure column thereby alleviating some of the cooling duty of the main or primary heat exchanger.

The aforementioned components of the feed air streams, namely oxygen, nitrogen, and argon are separated within the distillation column system 7 that consists of a higher pressure column 52 and a lower pressure column 54. It is understood that if argon were a necessary product, an argon column 56 could be incorporated into distillation column system 7. The higher pressure column 52 typically operates in the range from between about 20 bar(a) to about 60 bar(a) whereas the lower pressure column 54 typically operates at pressures between about 1.1 bar(a) to about 1.5 bar(a).

The higher pressure column 52 and the lower pressure column 54 are linked in a heat transfer relationship such that a nitrogen-rich vapor column overhead, extracted from the top of higher pressure column 52 as a stream 55, is condensed within a condenser-reboiler 57 located in the base of lower pressure column 54 against boiling an oxygen-rich liquid column bottoms 58. The boiling of oxygen-rich liquid column bottoms 58 initiates the formation of an ascending vapor phase within lower pressure column 54. The condensation produces a liquid nitrogen containing stream 60 that is divided into streams 62 and 64 that reflux the higher pressure column 52 and the lower pressure column 54, respectively to initiate the formation of descending liquid phases in such columns.

Exhaust stream 33 is introduced into the higher pressure column 52 along with the liquid air stream 48 for rectification by contacting an ascending vapor phase of such mixture within a plurality of mass transfer contacting elements, illustrated as contacting elements 66, 67, 68, with a descending liquid phase that is initiated by reflux stream 62. This produces a crude liquid oxygen column bottoms 70, also known as kettle liquid and the nitrogen-rich column overhead 55, and optionally a nitrogen-rich shelf draw 59. A stream 72 of the crude liquid oxygen column bottoms 70 is subcooled and then expanded in an expansion valve 74 to the pressure at or near that of the lower pressure column 54 and is introduced into the argon condenser 99 disposed within the lower pressure column 54, and subsequently released within the lower pressure column for further rectification. In addition, the second liquid air stream 46 is passed through an expansion valve 44, expanded to the pressure at or near that of the lower pressure column 54 and then introduced into lower pressure column 54.

Lower pressure column 54 is also provided with a plurality of mass transfer contacting elements, illustrated as contacting elements 78, 80, 82 and 84 that can be trays or structured packing or random packing or other known elements in the art of cryogenic air separation. As stated previously, the separation produces an oxygen-rich liquid column bottoms 58 extracted as an oxygen-rich liquid stream 98 and a nitrogen-rich vapor column overhead that is extracted as a nitrogen product stream 86. Additionally, a waste stream 88 is also extracted to control the purity of nitrogen product stream 86. Both nitrogen product stream 86 and waste stream 88 are passed through subcooling units 90A and 90B designed to subcool the reflux stream 64. A portion of the reflux stream 64 may optionally be taken as a liquid product stream 92 which is directed through valve into suitable storage vessel (not shown), and the remaining portion (shown as stream 93) may be introduced into lower pressure column 54 after passing through expansion valve 194. After passage through subcooling units 90A and 90B, nitrogen product stream 86 and waste stream 88 are fully warmed within main or primary heat exchanger 3 to produce a warmed nitrogen product stream 195 and a warmed waste stream 196. Although not shown, the warmed waste stream 196 may be used to regenerate the adsorbents within the pre-purification unit 16.

The argon column 56 operates at a pressure comparable to the pressure within the lower pressure column 54. The argon column receives an argon and oxygen containing vapor feed 94 from the lower pressure column 54, typically having a concentration of about 8% to 15% by volume argon, and a down-flowing argon rich reflux 98 received from an argon condensing assembly 99. The argon column 56 serves to rectify the argon and oxygen containing vapor feed 94 by separating argon from the oxygen into an argon enriched overhead vapor stream 95 and an oxygen-rich liquid stream 96 that that is released or returned into the lower pressure column 54. The mass transfer contacting elements 91A, 91B within the argon column 56 could be packing or trays. Possible column packing arrangements include structured packing, strip packing, or silicon carbide foam packing.

The resulting argon-rich vapor overhead stream 95 is then preferably directed to the argon condensing assembly 99 or argon condenser preferably also disposed within the structure of the lower pressure column where all or a portion of the argon-rich vapor overhead stream 95 is condensed into a crude liquid argon stream 98. The resulting crude liquid argon stream 98 is used as an argon-rich reflux stream for the argon column 56 or a portion may be optionally taken an impure or crude liquid argon stream (not shown). In the depicted embodiments, the argon-rich reflux stream 98 is directed back to the argon column and initiates the descending argon liquid phase that contacts the ascending argon and oxygen containing vapor feed 94. Likewise, a portion of the argon-rich vapor overhead stream 97 may be diverted and directed to the main heat exchanger 3 to recover refrigeration and yield a gaseous argon product 197.

Production of Oxygen Products and Gaseous Oxygen Bypass

As briefly described above, an oxygen-rich liquid stream 98 is extracted from the oxygen-rich liquid column bottoms 58 near the bottom of the lower pressure column 54. Oxygen-rich liquid stream 98 can be pumped via pump 109 to form a pumped product stream as illustrated by pumped liquid oxygen stream 100. Part of the pumped liquid oxygen stream 100 can optionally be taken directly as a liquid oxygen product stream 102 which is directed through valve 105 into suitable storage vessel (not shown), with the remainder, namely stream 104, being directed to the main or primary heat exchanger 3 where it is warmed and vaporized to produce a pressurized oxygen product stream 106.

The gaseous oxygen bypass arrangement is implemented by extracting a stream of gaseous oxygen 201 from the lower pressure column 54 at a location above the main condenser-reboiler 57. The gaseous oxygen bypass stream 201 preferably contains not less than 80%, and more preferably 90% gaseous oxygen by volume. The extracted gaseous oxygen stream 201 is then directed from the lower pressure column 54 to the primary or main heat exchanger 3 where part or all of the refrigeration from the extracted gaseous oxygen stream 201 is recovered. The warmed gaseous oxygen stream 200 is then available for recycle, venting or other use as appropriate.

As described in more detail below, concurrent with the extraction of the gaseous oxygen bypass stream 201, the pressure of the further compressed boiler air stream 24 reduced and/or the relative split of incoming compressed and purified air is adjusted such that the volumetric ratio of the boiler air stream 24 directed to the primary heat exchanger 3 to the turbine air stream 30 directed to the primary heat exchanger 3 is reduced to a ratio of between about 0.15:1 and about 0.35:1.

Gaseous Oxygen Bypass at Full Flow

Figure 2:
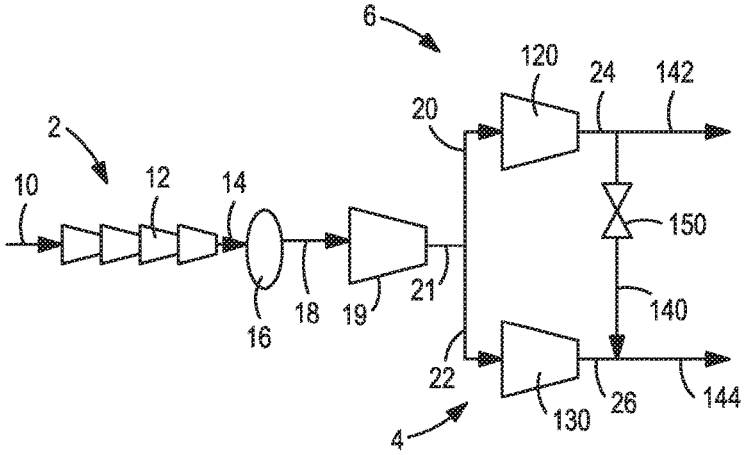
FIG. 2 is a schematic representation of a 'warm-end' air compression circuit suitable for use in a cryogenic air separation unit configured to produce a high pressure gaseous oxygen product in accordance with the present methods.
Figure 3:
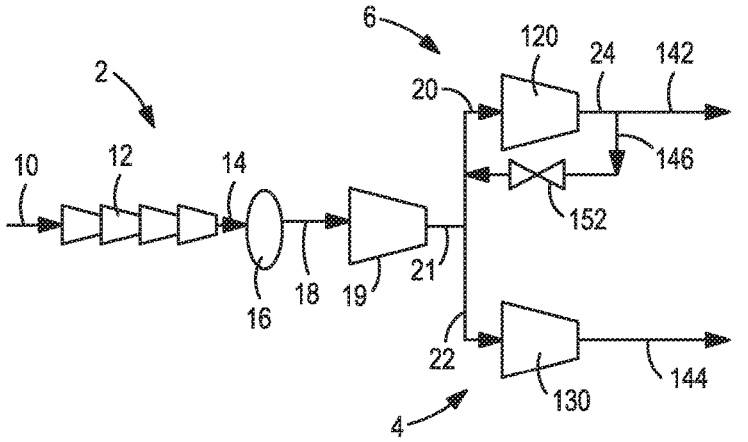
FIG. 3 is a schematic representation of an alternate embodiment of the 'warm-end' air compression circuit configured for use with the gaseous oxygen bypass arrangement and having certain aspects and/or features of the present methods.
Figure 4:
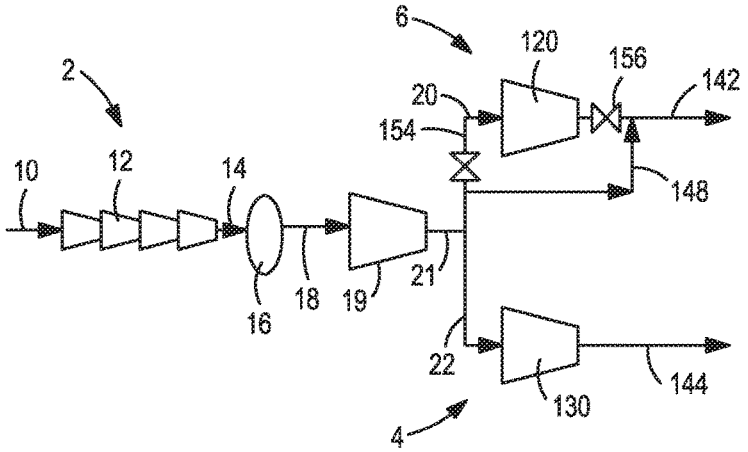
FIG. 4 is a schematic representation of another embodiment of the 'warm-end' air compression circuit configured for use with the gaseous oxygen bypass arrangement and having certain aspects and/or features of the present methods.

Turning now to FIGS. 2-4, several embodiments of the present gaseous oxygen bypass arrangement are shown. When operating the air separation unit with gaseous oxygen bypass in full flow mode, the compressed and purified feed air stream 18 may be further compressed in compressor 19 and then split into a boiler air stream 20 and turbine air stream 22. The flow split of the compressed and purified air stream 21 exiting compressor 19 is the standard or designed flow split of about 60% to 70%, and more preferably about 65% turbine air stream 22 and between about 30% to 40%, and more preferably about 35%, boiler air stream 20.

In the embodiment of FIG. 2, the flow split exiting compressor 19 is the standard or designed flow split of about 65% to 70% turbine air stream 22 and about 35% to 30% boiler air stream 20. The boiler air stream 20 is then still further compressed in boiler air compressor 120 to a targeted pressure to produce the further compressed boiler air stream 24. Concurrently, the turbine air stream 22 is further optionally compressed in a turbine air compressor 130 to a targeted pressure to produce the further compressed turbine air stream 26. A cross-tie arrangement is also employed that comprises a crossflow stream 140 that is diverted from the further compressed boiler air stream 24 to the optionally further compressed turbine air stream 26. The volume of the crossflow stream 140 diverted is sufficient to reduce the volume of the final boiler air stream 142 to preferably between about 15% to 25% of the full-flow compressed and purified feed air stream 18 and to increase the final turbine air stream 144 to preferably between about 75% to 85% of the full-flow compressed and purified feed air stream 18. Valve 150 is opened to initiate the reduction in boiler air flow during the gaseous oxygen bypass operation and thereafter used to control the effective final split between final boiler air stream and final turbine air stream during the gaseous oxygen bypass operation.

The cross-tie arrangement from the boiler air stream circuit to the turbine air stream circuit allows both the boiler air compressor 120 and the turbine air compressor 130 to operate at or very close to the design flows thereby maintaining higher efficiency when operating in both standard operating mode and in gaseous oxygen bypass mode. Multiple techniques may be employed, such as use of turbine nozzles and boiler air compressor guide vanes, to ensure the pressure in the boiler air stream circuit downstream of the boiler air stream compressor 120 is higher than the pressure in the turbine air stream circuit to direct a portion of the flow through the cross-tie conduit when operating in the gaseous oxygen bypass mode.

In the embodiment of FIG. 3, the flow split exiting compressor 19 is the same as in the embodiment of FIG. 2 or preferably 65% to 70% turbine air stream 22 and 35% to 30% boiler air stream 20. The boiler air stream 20 is again further compressed in boiler air compressor 120 to a targeted pressure to produce the further compressed boiler air stream 24. Concurrently, the turbine air stream 22 is further optionally compressed in turbine air compressor 130 to a targeted pressure to produce the further compressed turbine air stream 26, 144. A recirculation stream 146 is diverted from the further compressed boiler air stream 24 to the incoming boiler air stream 20. The volume of the recirculation stream diverted is sufficient to reduce the volume of the final boiler air stream 142 to less than 25% of the full-flow compressed and purified feed air stream 18, and preferably between about 15% to 25% of the full-flow compressed and purified feed air stream 18. The volumetric flow of the final turbine air stream remains unchanged. Valve 152 is opened to initiate the reduction in final boiler air stream flow during the gaseous oxygen bypass operation and thereafter used to control the effective volume of the final boiler air stream directed to the primary heat exchanger during the gaseous oxygen bypass operation. This arrangement is particularly beneficial when the flow requirement for final boiler air stream 142 is reduced to a point where the boiler air stream compressor 120 needs to be operated in a manner that avoids a surge condition.

In the embodiment of FIG. 4, the flow split exiting compressor 19 is again roughly 65% to 70% turbine air stream 22 and about 35% to 30% boiler air stream 20. The boiler air stream 20 is again further compressed in compressor 120 to a targeted pressure to produce the further compressed boiler air stream 24. Concurrently, the turbine air stream 22 is further optionally compressed in a turbine air compressor 130 to a targeted pressure to produce the further compressed turbine air stream 26, 144. A portion of the boiler air stream 20 is diverted as a boiler air bypass stream 148 to the final boiler air stream 142. As the boiler air bypass stream 148 is not compressed in boiler air compressor 120, the pressure of the final boiler air stream 142 is reduced. The volume of the recirculation stream diverted is sufficient to reduce the pressure volume of the final boiler air stream 142 while keeping the volume of the final boiler air stream at roughly 35% of the full-flow compressed and purified feed air stream 18. The volume of the final turbine air stream remains unchanged at about 65% of the full-flow compressed and purified feed air stream 18. Valves 154, 156 are closed to initiate the reduction in pressure of the final boiler air stream flow during the gaseous oxygen bypass operation and thereafter used to control the pressure of the final boiler air stream directed to the primary heat exchanger during the gaseous oxygen bypass operation.

Figure 5:
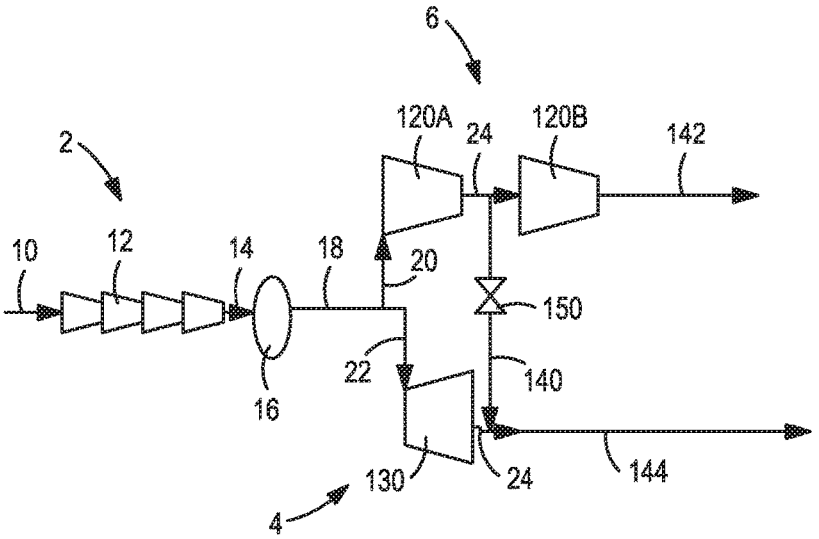
FIG. 5 is a schematic representation of yet another embodiment of the 'warm-end' air compression circuit configured for use with the gaseous oxygen bypass arrangement and having certain aspects and/or features of the present methods.
Figure 6:
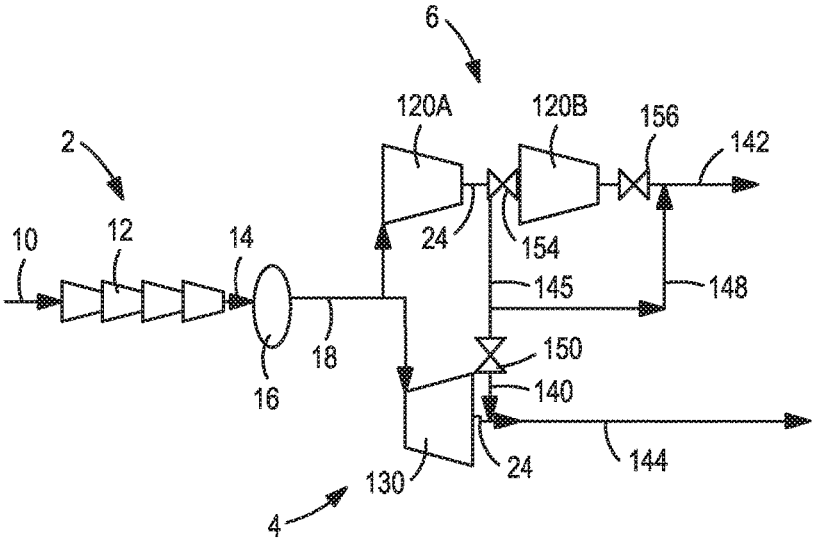
FIG. 6 is a schematic representation of still another embodiment of the 'warm-end' air compression circuit configured for use with the gaseous oxygen bypass arrangement and having certain aspects and/or features of the present methods.

Turning now to FIGS. 5 and 6, additional embodiments of the present gaseous oxygen bypass arrangement are shown that are configured to operate full flow mode. In these two embodiments, the incoming feed air 10 is compressed in a multi-stage, intercooled main air compressor arrangement 12 to a pressure that can be between about 5 bar(a) and about 15 bar(a). The cool, dry compressed air feed 14 is then purified in a pre-purification unit 16 to remove high boiling contaminants from the cool, dry compressed air feed 14 to form the compressed and purified feed air stream 18. The compressed and purified feed air stream 18 is then split into a boiler air stream 20 and turbine air stream 22. The flow split of the compressed and purified air stream 18 is about 65% of the flow forms the turbine air stream 22 and about 35% of the incoming flow forms the boiler air stream 20. The boiler air stream 20 is preferably directed to a multi-stage, intercooled boiler air compressor arrangement 120A, 120B where it is further compressed to form a final boiler air stream 142 at a targeted pressure. Likewise, the turbine air stream 22 is further compressed in a turbine air compressor 130 (e.g T-stage compressor).

In the embodiment of FIG. 5, a cross-flow stream 140 is diverted from an intermediate stage of the boiler air compressor arrangement and directed to and combined with the further compressed turbine air stream 144. The volume of the crossflow stream diverted is sufficient to reduce the volume of the final boiler air stream 142 to preferably between about 15% to 25% of the full-flow compressed and purified feed air stream 18 and to increase the final turbine air stream 144 to preferably between about 75% to 85% of the full-flow compressed and purified feed air stream 18. Valve 150 is opened to initiate the reduction in boiler air flow during the gaseous oxygen bypass operation and thereafter used to control the effective final split between final boiler air stream and final turbine air stream during the gaseous oxygen bypass operation.

In the embodiment of FIG. 6, all or a portion of the boiler air stream is diverted from an intermediate stage of the boiler air compressor arrangement 120A, 120B as a boiler air diverted stream 145. A first portion of the boiler air diverted stream 148 is directed to the final boiler air stream 142 while a second portion 140 is diverted to and combined with the further compressed turbine air stream 144. As the first portion of the boiler air diverted stream 148 is not compressed in later compression stages of the boiler air compressor arrangement 120B, the pressure of the final boiler air stream 142 is reduced during the high pressure gaseous oxygen bypass mode compared to the high pressure gaseous oxygen full product mode. The volume of the second portion of the boiler air diverted stream 140 that is diverted to the further compressed turbine air stream 144 is sufficient to reduce the volume of the final boiler air stream 142 to preferably between about 15% to 25% of the full-flow compressed and purified feed air stream 18 and to increase the final turbine air stream 144 to preferably between about 75% to 85% of the full-flow compressed and purified feed air stream 18. Valves 150, 154, 156 are used to control the flows and pressure of the diverted boiler air streams 140, 145, 148 as well as the final boiler air stream 142 directed to the heat exchanger during the gaseous oxygen bypass operation.

In both embodiments of FIG. 5 and FIG. 6, the cross-tie arrangement from an intermediate stage of the boiler air compressor to the final turbine air stream allows both the initial stages of the boiler air compressor 120A and the turbine air compressor 130 to operate at or very close to their respective design flows thereby maintaining higher operating efficiency when operating in both standard operating mode and in gaseous oxygen bypass mode.

Gaseous Oxygen Bypass at Turndown

In the case of turn-down operation, where the air separation plant is configured to receive less than 85% of the full-flow design capacity, the gaseous oxygen bypass arrangements discussed above with reference to FIGS. 2-6 offer additional flexibility. Such gaseous oxygen bypass arrangements suitable for most turndown operations include a crossflow arrangement (See FIGS. 2 and 5); bypass arrangement (See FIG. 4); and intermediate stage diversion arrangement (See FIG. 6).

For example, in turndown mode, the valves 150, 152, 154, 156 are controlled so as to reduce the pressure and/or volume of the final boiler air stream 142 to preferably between about 20% to 30% of the reduced flow (i.e. turndown) compressed and purified feed air stream (or between about 15% to 20% of the designed, full-flow compressed and purified feed air stream) and to increase the final turbine air stream 144 to preferably between about 70% to 80% of the reduced flow (i.e. turndown) compressed and purified feed air stream (or between about 80% to 85% of the designed, full-flow compressed and purified feed air stream).

Comparative Examples

Power Consumption & Liquid Make in Full Flow Mode

A number of computer simulations were run using air separation unit operating models to characterize: (i) relative power consumption; (ii) liquid product make; (iii) argon recovery; and (iv) lower column turbine (LCT) efficiency when operating an air separation unit using the gaseous oxygen bypass (GOX Bypass) arrangements in full flow mode (as shown in the associated Figures and described above) relative to the power consumption, liquid product make, argon recovery and turbine efficiency of the same air separation unit in full flow mode without GOX bypass and thereby maximizing the availability of high pressure gaseous oxygen. As seen in Table 1, Case 1 represents the baseline operation of an LCT based air separation unit (See FIG. 1) in full flow mode (i.e. total incoming air flow at 100%). The split of the incoming compressed and purified feed air is 69% diverted to the turbine air circuit and 31% directed to the boiler air circuit. In this baseline Case 1, no GOX bypass is taken and 283 kcfh of high pressure gaseous oxygen is available as the gaseous oxygen product. Net liquid product make is roughly 169.6 kcfh with 8.48% of the incoming feed air being converted to liquid nitrogen (LIN) and/or liquid oxygen (LOX). Argon recovery is at about 89.7% and the maximum LCT turbine efficiency at the turbine design point is estimated to be about 90%.

Case 2 (See FIG. 1 with GOX Bypass and about 69% turbine air/total air); Case 3 (See FIG. 1 with 75% turbine air/total air); Case 4 (See FIG. 3 with GOX Bypass and 81% turbine air/total air); Case 5 (See FIG. 4 with GOX Bypass and 75% turbine air/total air), and Case 6 (See FIG. 2 with GOX Bypass and 75% turbine air/total air) represent the operation of the LCT based air separation unit of Case 1 in full flow mode but with the GOX bypass operating at different flow rates and/or with variations to the warm-end air compression circuits.

TABLE 1

| | | Case | | | | | |
|---|---|---|---|---|---|---|---|
| | | Case 1 | Case 2 | Case 3 | Case 4 | Case 5 | Case 6 |
| | | Reference FIG. | | | | | |
| | | FIG. 1 | FIG. 1 | FIG. 1 | FIG. 3 | FIG. 4 | FIG. 2 |
| Total Air Flow | | 100% | 100% | 100% | 100% | 100% | 100% |
| Turbine Air/Total Air | % | 69% | 69% | 75% | 81% | 75% | 75% |
| GOX Bypass Utilized | Y/N | No | Yes | Yes | Yes | Yes | Yes |
| High Pressure GOX available | kcfh | 283 | 188 | 110 | 43 | 139 | 90 |
| Low Pressure GOX Bypass | kcfh | 0 | 82 | 150 | 213 | 128 | 165 |
| Net Liquid Make (after flash) | kcfh | 169.6 | 185.7 | 196.4 | 198.5 | 189.1 | 202.4 |
| Net LIN + LOX Make (% of feed air) | % | 8.48% | 9.29% | 9.82% | 9.92% | 9.46% | 10.12% |
| Argon Recovery | % | 89.7% | 89.6% | 91.3% | 91.3% | 91.2% | 91.3% |
| Relative Power (relative to Case 1) | % | 100% | 99.0% | 98.5% | 99.3% | 95.0% | 98.5% |
| Estimated Turbine Efficiency | % | 90% | 87.2% | 85.5% | 85.4% | 86.9% | 84.5% |
| Turbine Efficiency Penalty (relative to Case 1) | | 0% | 2.8% | 4.5% | 4.6% | 3.1% | 5.5% |

As seen in Table 1, some of the characterizations of the GOX bypass performance are expressed in comparative relationship to baseline Case 1. While Case 2 shows a 1% improvement in power consumption compared to baseline Case 1, the GOX bypass arrangements in Case 3, Case 4, Case 5, and Case 6 all show further improvements in the relative power consumption. Specifically, the relative power consumption of Case 3 through Case 6 are between 1.5% and 5% lower baseline Case 1 and 0.5% to 4% better than Case 2.

With regard to the liquid product make, Case 2 shows 185.7 kcfh of net liquid product make after flash which represents an improvement of 9.5% over baseline Case 1. Case 3 shows 196.4 kcfh of net liquid product make after flash which represents an improvement of 15.8% over baseline Case 1 while Case 4 shows 198.5 kcfh of net liquid product make after flash which represents an improvement of 17.0% over baseline Case 1. The simulation depicted as Case 5 shows 189.1 kcfh of net liquid product make after flash which represents an improvement of 11.5% over baseline Case 1 and a 1.8% improvement over Case 2 while Case 6 shows 202.4 kcfh of net liquid product make after flash which represents an improvement of 19.0% over baseline Case 1 and a 9.0% improvement over Case 2 (See FIG. 1 with GOX Bypass and about 69% turbine air/total air).

In addition, Case 3 (See FIG. 1 with 75% turbine air/total air), Case 4 (See FIG. 3 with 81% turbine air/total air), Case 5 (See FIG. 4 with 75% turbine air/total air), and Case 6 (See FIG. 2 with 75% turbine air/total air) all demonstrate a significant improvement in argon recovery compared to both baseline Case 1 and standard GOX bypass of Case 2. Specifically, the argon recovery in the GOX Bypass arrangements simulated in Case 3, Case 4, and Case 6 was increased to about 91.3%.

As expected, the lower column turbine (LCT) efficiency of was reduced and the associated penalty in turbine efficiency was greater in all GOX bypass arrangements compared to baseline Case 1.

Power Consumption & Liquid Make in Turndown Mode

A number of additional computer simulations were run using air separation unit operating models to characterize: (i) relative power consumption; (ii) liquid product make; (iii) argon recovery; and (iv) lower column turbine (LCT) efficiency when operating an air separation unit using the gaseous oxygen bypass (GOX Bypass) arrangements in turndown mode (e.g. 80% of full flow). As seen in Table 2, Case 1 represents the baseline operation of an LCT based air separation unit (See FIG. 1) in full flow mode (i.e. total incoming air flow at 100%) with 69% of the incoming compressed and purified feed air diverted to the turbine air circuit and the remaining 31% directed to the boiler air circuit. In this same baseline Case 1, no GOX bypass is taken and 283 kcfh of high pressure gaseous oxygen is available as the gaseous oxygen product. Net liquid product make is roughly 169.6 kcfh with 8.48% of the incoming feed air being converted to liquid nitrogen (LIN) and/or liquid oxygen (LOX). Argon recovery is at about 89.7% and the maximum LCT turbine efficiency at the turbine design point is estimated to be about 90%.

Case 7 depicts the air separation unit in 20% turndown mode (i.e. 80% of full flow incoming air) with 69% of the incoming compressed and purified feed air diverted to the turbine air circuit and the remaining 31% directed to the boiler air circuit. In this 'turndown baseline' arrangement, no GOX bypass is taken and 228 kcfh of high pressure gaseous oxygen is available as the gaseous oxygen product. Net liquid product make is roughly 132.9 kcfh with 8.31% of the incoming feed air being converted to liquid nitrogen (LIN) and/or liquid oxygen (LOX). Argon recovery is at about 89.8% and the maximum LCT turbine efficiency at the turbine design point is estimated to be about 86.3% with an expected relative power usage of about 80.2% of the Case 1 baseline.

In Table 2, Case 8 represents a general ASU plant configuration with 77% of the incoming compressed and purified feed air diverted to the turbine air circuit and the remaining 23% directed to the boiler air circuit or a 77% turbine air/total air ratio. Case 9 represents the embodiment with the warm-end air compression arrangement of FIG. 3 with GOX Bypass and 82% turbine air/total air. Case 10 represents the embodiment with the warm-end air compression arrangement of FIG. 4 with GOX Bypass and 77% turbine air/total air. The key differences between the turndown baseline of Case 7 and the other Cases in Table 2 include the GOX bypass operating at different flow rates and/or with variations to the warm-end air compression circuits.

TABLE 2

| | | Case | | | | |
|---|---|---|---|---|---|---|
| | | Case 1 | Case 7 | Case 8 | Case 9 | Case 10 |
| | | Reference FIG. | | | | |
| | | FIG. 1 | FIG. 1 | FIG. 3 | FIG. 4 | FIG. 2 |
| Total Air Flow | | 100% | 80% | 80% | 80% | 80% |
| Turbine Air/Total Air | % | 69% | 69% | 77% | 82% | 77% |
| GOX Bypass Utilized | Y/N | No | No | Yes | Yes | Yes |
| High Pressure GOX available | kcfh | 283 | 228 | 21 | 21 | 21 |
| Low Pressure GOX Bypass | kcfh | 0 | 0 | 174 | 182 | 174 |
| Net Liquid Make (after flash) | kcfh | 169.6 | 132.9 | 166.7 | 157.2 | 166.7 |
| Net LIN + LOX Make (% of feed air) | % | 8.48% | 8.31% | 10.4% | 9.82% | 10.4% |
| Argon Recovery | % | 89.7% | 89.8% | 91.4% | 91.6% | 91.4% |
| Relative Power (relative to Case 1) | % | 100% | 80.2% | 79.7% | 76.6% | 78.6% |
| Estimated Turbine Efficiency | % | 90% | 86.3% | 88.5% | 89.4% | 88.5% |
| Turbine Efficiency Penalty (relative to Case 1) | % | 0% | 3.7% | 1.5% | 0.6% | 1.5% |

As seen in Table 2, some of the characterizations of the GOX bypass performance under turndown conditions are expressed in comparative relationship to baseline Case 1. As expected, turndown Case 7 shows roughly a 20% improvement in power consumption compared to full-flow baseline Case 1. However, the GOX bypass arrangements in Case 8, Case 9, and Case 10 all show further improvements in the relative power consumption beyond the 20% turndown reduction of Case 7. Specifically, the relative power consumption in Case 8, Case 9, and Case 10 are respectively 0.5%; 3.6%; and 1.6% lower than turndown baseline Case 7.

With regard to the liquid product make, Case 8 and Case 10 both show 166.7 kcfh of net liquid product make after flash which represents an improvement of 25.4% more net liquid make over turndown baseline Case 7. Case 9 shows 157.2 kcfh of net liquid product make after flash which represents an improvement of 18.3% over turndown baseline Case 7. In fact, the net liquid product make in Case 8, Case 9, and Case 10 are comparable to Case 1 (baseline at full flow), with the net liquid product make in Case 8 and Case 10 being only 1.7% below that of Case 1.

In addition, Case 8, Case 9 and Case 10 all demonstrate an improvement in argon recovery compared to both full flow baseline Case 1 and turndown baseline of Case 7. Specifically, the argon recovery in the GOX Bypass arrangements simulated in Case 8, Case 9, and Case 10 was 91.4; 91.6; and 91.4 respectively.

Lastly, the lower column turbine (LCT) efficiency estimated in Case 8, Case 9, and Case 10 was only slightly lower at 88.46%; 89.36%; and 88.46% than the maximum estimated efficiency of 90% at the turbine design point in Case 1. More advantageously, the lower column turbine (LCT) efficiency estimated in GOX Bypass simulations in Case 8, Case 9, and Case 10 were all more than 2.4% better than the estimated turbine efficiency in the GOX bypass simulations at full flow (See Case 3, Case 4, Case 5 and Case 6).

Achieving relatively high turbine efficiency when using some or all of the GOX Bypass arrangements discussed above is not only possible, but an important feature of the present GOX Bypass arrangements. It is well known that when utilizing radial inflow turbines to produce refrigeration in an air separation unit, such turbines are generally controlled using techniques that rely on Bailje turbine charts, which plot turbine specific speed ($N_s$) against turbine specific diameter ($D_s$). In a generalized sense, the Bailje turbine charts for radial inflow turbines include one or more defined ridges of high turbine efficiency that exists across the entire range of possible turbine operating points, plotted on the Bailje turbine chart by turbine specific speed ($N_s$) and turbine specific diameter ($D_s$).

Ideally, for performance and economic reasons, the operation and control of an air separation unit turbine should track close to this 'ridge' of high efficiency even when there is a significant deviation in turbine flow, pressure, temperature, etc. relative to the maximum efficiency point. Conversely moving away from the high efficiency 'ridge' in a generally perpendicular orientation (as depicted on the Bailje turbine chart) should be avoided as such operational changes can result in a dramatic change in turbine efficiency for a relatively small change in turbine operating conditions. Turbine specific speed ($N_s$) and turbine specific diameter ($D_s$) for an air separation turbine can be calculated using only the inlet and outlet conditions of the operating turbine, which can be directly measured or indirectly ascertained given other process measurements of the air separation unit.

Utilizing this Bailje turbine chart information and techniques to control the operation of an air separation unit turbine at a relatively high efficiency when the GOX bypass feature is being utilized is particularly important because the use of the GOX bypass feature has a large and direct impact on the operating turbine flow and temperature. Changes in the turbine fluid temperature and turbine speed typically have a large impact on moving the turbine operating point ($N_s$; $D_s$) in a direction perpendicular to the 'ridge' of high turbine efficiency on the Bailje turbine charts. To a lesser extent adjusting the turbine mass flow also has an effect of moving the turbine operating point off the 'ridge' of high turbine efficiency. Increasing turbine temperature generally decreases $N_s$ (at roughly constant $D_s$) thus moving the operating point (left while increasing turbine mass flow generally moves the operating point ($N_s$; $D_s$) down and to the right. Turbine inlet temperature and turbine mass flow serve as easily measurable variables that should be adjusted to keep the turbine operating at a position of relative high efficiency relative to the maximum efficiency design point.

Although the present invention has been discussed with reference to one or more preferred embodiments and methods, as would occur to those skilled in the art that numerous changes and omissions can be made without departing from the spirit and scope of the present inventions as set forth in the appended claims.

What is claimed is:

1. A method for producing a high pressure gaseous oxygen product in an air separation plant comprising a primary heat exchanger and a distillation column system with a higher pressure column, a lower pressure column, and a main condenser-reboiler disposed in the lower pressure column and in a heat exchange relationship with the lower pressure column and higher pressure column, the air separation unit is configured to be operated in a high pressure gaseous oxygen full product mode and a high pressure gaseous oxygen bypass mode, the method comprising the steps of:

(a) compressing and purifying a stream of feed air, the stream of feed air having a first volumetric flow rate;

(b) splitting the stream of compressed and purified feed air into two or more streams including a boiler air stream and a turbine air stream, wherein the volumetric flow ratio of the boiler air stream to the turbine air stream is between about 0.40:1 and 0.70:1;

(c) directing the boiler air stream to a boiler air circuit configured to further compress the boiler air stream in a boiler air compressor and directing the turbine air stream to a turbine air circuit configured to partially cool the turbine air stream in the primary heat exchanger and expand the turbine air stream and produce refrigeration for the distillation column system;

(d) cooling the further compressed boiler air stream in the primary heat exchanger via indirect heat exchange with a stream of liquid oxygen taken from the lower pressure column to produce a first cooled, compressed feed air stream and a gaseous oxygen product;

(e) directing the first cooled, compressed feed air stream to the higher pressure column, the lower pressure column or both columns and directing the expanded turbine air stream to the higher pressure column or the lower pressure column;

(f) rectifying the cooled, compressed feed air stream and the expanded turbine air stream in the distillation column system to produce a stream of gaseous nitrogen product, a stream on liquid nitrogen, a stream of waste nitrogen, the stream of liquid oxygen; and optionally one or more argon products; and (g) warming all or a portion of the liquid oxygen stream in the primary heat exchanger to produce the high pressure gaseous oxygen product;

wherein when in the air separation plant operates in a high pressure gaseous oxygen bypass mode, the method further comprises the steps of:

(h) extracting a stream of gaseous oxygen from the lower pressure column at a location above the main condenser-reboiler;

(i) recovering part or all of the refrigeration from the extracted gaseous oxygen stream in the primary heat exchanger; and (j) reducing the volumetric ratio of the further compressed boiler air stream directed to the primary heat exchanger to the turbine air stream directed to the primary heat exchanger to between about 0.15:1 and 0.35:1.

2. The method of claim 1 wherein between about 10% less power and 20% less power is used to make same volume of liquid nitrogen and liquid oxygen when operating in the high pressure gaseous oxygen bypass mode compared to operating in the high pressure gaseous oxygen full product mode.

3. The method of claim 1 wherein between 5% and 10% additional of liquid products are made when operating in the high pressure gaseous oxygen bypass mode compared to operating in the high pressure gaseous oxygen full product mode.

4. The method of claim 1 wherein the volumetric flow rate of the stream of feed air during the high pressure gaseous oxygen bypass mode is about equal to the first volumetric flow rate.

5. The method of claim 1 wherein the volumetric flow rate of the stream of feed air during the high pressure gaseous oxygen bypass mode is between about 85% and 100% of the first volumetric flow rate.

6. The method of claim 1 wherein the air separation plant is operated in a turndown mode wherein the first volumetric flow rate is less than 85% of the designed volumetric flow rate of the air separation plant.

7. The method of claim 1 wherein the step of reducing the volumetric ratio of the further compressed boiler air stream directed to the primary heat exchanger to the turbine air stream directed to the primary heat exchanger to between about 0.15:1 and 0.35:1 further comprises diverting a portion of the further compressed boiler air stream from a location upstream of the primary heat exchanger to the turbine air circuit.

8. The method of claim 1 wherein the step of reducing the volumetric ratio of the further compressed boiler air stream directed to the primary heat exchanger to the turbine air stream directed to the primary heat exchanger to between about 0.15:1 and 0.35:1 further comprises recirculating a portion of the further compressed boiler air stream from a location upstream of the primary heat exchanger to a location in the boiler air circuit upstream of the boiler air compressor.

9. The method of claim 1 further comprising the step of diverting a portion of the boiler air stream from a location in the boiler air circuit upstream of the boiler air compressor to a location in the boiler air circuit downstream of the boiler air compressor so as to avoid further compression of said portion of the boiler air stream.

10. The method of claim 1 wherein the step of reducing the volumetric ratio of the further compressed boiler air stream directed to the primary heat exchanger to the turbine air stream directed to the primary heat exchanger to between about 0.15:1 and 0.35:1 further comprises diverting a portion of the further compressed boiler air stream from a location upstream of the primary heat exchanger to the turbine air circuit and further comprising the step of diverting a portion of the boiler air stream from a location in the boiler air circuit upstream of the boiler air compressor to a location in the boiler air circuit downstream of the boiler air compressor so as to avoid further compression of said portion of the boiler air stream.

11. The method of claim 1 wherein the boiler air compressor is a multi-stage boiler air compressor arrangement.

12. The method of claim 11 wherein the step of reducing the volumetric ratio of the further compressed boiler air stream directed to the primary heat exchanger to the turbine air stream directed to the primary heat exchanger to between about 0.15:1 and 0.35:1 further comprises diverting a portion of the boiler air stream from an intermediate stage of the multi-stage boiler air compressor arrangement to the turbine air circuit.

13. The method of claim 11 wherein the step of reducing the volumetric ratio of the further compressed boiler air stream directed to the primary heat exchanger to the turbine air stream directed to the primary heat exchanger to between about 0.15:1 and 0.35:1 further comprises further comprises diverting a portion of the boiler air stream from an intermediate stage of the multi-stage boiler air compressor arrangement to a location in the boiler air circuit downstream of the last stage of the multi-stage boiler air compressor arrangement so as to avoid further compression of said portion of the boiler air stream.

14. The method of claim 11 wherein the step of reducing the volumetric ratio of the further compressed boiler air stream directed to the primary heat exchanger to the turbine air stream directed to the primary heat exchanger to between about 0.15:1 and 0.35:1 further comprises diverting a first portion of the boiler air stream from an intermediate stage of the multi-stage boiler air compressor arrangement to the turbine air circuit and further comprising the step of diverting a second portion of the boiler air stream from an intermediate stage of the multi-stage boiler air compressor arrangement to a location in the boiler air circuit downstream of the last stage of the multi-stage boiler air compressor arrangement so as to avoid further compression of said second portion of the boiler air stream.

15. A method for producing a high pressure gaseous oxygen product in an air separation plant comprising a primary heat exchanger and a distillation column system with a higher pressure column, a lower pressure column, and a main condenser-reboiler disposed in the lower pressure column and in a heat exchange relationship with the lower pressure column and higher pressure column, the air separation unit is configured to be operated in a high pressure gaseous oxygen full product mode and a high pressure gaseous oxygen bypass mode, the method comprising the steps of:

(a) compressing and purifying a stream of feed air, the stream of feed air having a first volumetric flow rate;

(b) splitting the stream of compressed and purified feed air into two or more streams including a boiler air stream and a turbine air stream, wherein the volumetric flow ratio of the boiler air stream to the turbine air stream is between about 0.4:1 and 0.7:1;

(c) directing the boiler air stream to a boiler air circuit configured to optionally further compress the boiler air stream in a boiler air compressor and directing the turbine air stream to a turbine air circuit configured to optionally compress the turbine air stream in a turbine air compressor and partially cool the turbine air stream in the primary heat exchanger and thereafter expand the partially cooled turbine air stream and produce refrigeration for the distillation column system;

(d) cooling the further compressed boiler air stream in the primary heat exchanger via indirect heat exchange with a stream of liquid oxygen taken from the lower pressure column to produce a first cooled, compressed feed air stream and a gaseous oxygen product;

(e) directing the first cooled, compressed feed air stream to the higher pressure column, the lower pressure column or both columns and directing the expanded turbine air stream to the higher pressure column or the lower pressure column;

(f) rectifying the cooled, compressed feed air stream and the expanded turbine air stream in the distillation column system to produce a stream of gaseous nitrogen product, a stream on liquid nitrogen, a stream of waste nitrogen, the stream of liquid oxygen; and optionally one or more argon products; and (g) warming all or a portion of the liquid oxygen stream in the primary heat exchanger to produce the high pressure gaseous oxygen product;

wherein when the air separation plant operates in a high pressure gaseous oxygen bypass mode, the method further comprises the steps of:

(h) extracting a stream of gaseous oxygen from the lower pressure column at a location above the main condenser-reboiler;

(i) recovering part or all of the refrigeration from the extracted gaseous oxygen stream in the primary heat exchanger; and (j) directing the boiler air stream in the boiler air circuit to the primary heat exchanger while bypassing boiler air compressor so as to avoid further compression of the boiler air stream.

16. The method of claim 15 further comprising the step of reducing the volumetric ratio of the boiler air stream directed to the primary heat exchanger to the turbine air stream directed to the primary heat exchanger to between about 0.17:1 and 0.33:1 when the air separation plant operates in a high pressure gaseous oxygen bypass mode.

17. The method of claim 16 wherein the step of reducing the volumetric ratio of the boiler air stream directed to the primary heat exchanger to the turbine air stream directed to the primary heat exchanger to between about 0.17:1 and 0.33:1 when the air separation plant operates in a high pressure gaseous oxygen bypass mode further comprises diverting a portion of the boiler air stream from a location upstream of the primary heat exchanger to the turbine air circuit.

* * * * *